US006832760B2

(12) United States Patent
Jewell

(10) Patent No.: US 6,832,760 B2
(45) Date of Patent: Dec. 21, 2004

(54) AUTOMATICALLY DETECTING MULTIPLE SHEETS OF PRINT MEDIA

(75) Inventor: Robert W. Jewell, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 41 days.

(21) Appl. No.: 10/238,956

(22) Filed: Sep. 9, 2002

(65) Prior Publication Data

US 2004/0046315 A1 Mar. 11, 2004

(51) Int. Cl.[7] ..... B65H 7/02

(52) U.S. Cl. ..... 271/258.01; 271/262; 271/263; 271/265.04

(58) Field of Search ..... 271/258.01, 262, 271/263, 258.04, 265.04

(56) References Cited

U.S. PATENT DOCUMENTS 5,201,424 A * 4/1993 Hain ..... 209/534
5,927,703 A * 7/1999 Endo ..... 271/10.03
5,934,140 A * 8/1999 Jackson et al. ..... 73/159
6,068,254 A * 5/2000 Olexy ..... 271/106
6,082,732 A * 7/2000 Hutchison et al. ..... 271/265.04
6,481,705 B1 * 11/2002 Okada ..... 271/4.03
6,540,222 B2 * 4/2003 Araki et al. ..... 271/122
6,672,587 B1 * 1/2004 Mohringer et al. ..... 271/259

* cited by examiner

*Primary Examiner*—David H. Bollinger

(57) ABSTRACT

An implementation of a technology is described herein for automatically detecting when multiple sheets of print media are fed into a print device. More particularly, described herein is a technology for indirectly and automatically determining the number of sheets of print media by determining the stiffness of print media, such as acetate and paper. At least one embodiment, described herein, includes a registration assembly of a laser printer. In this assembly, the print medium is deflected (i.e., bent, bowed, buckled, etc.). A measurement of such deflection is made. That measurement is an indication of the relative stiffness of the print medium. Assuming approximately similar densities, the stiffness of print media is directly related to its thickness. The thicker the medium the stiffer it is and vice versa. The thickness of print media is directly related to the number of sheets of print media.

37 Claims, 3 Drawing Sheets

AUTOMATICALLY DETECTING MULTIPLE SHEETS OF PRINT MEDIA

RELATED APPLICATIONS

This application is related to the following U.S. patent application, the disclosure of which is incorporated by reference herein:

application Ser. No. 10/081497, filed Feb. 20, 2002, entitled "Automatically Determining Heat-Conductive Properties of Print Media" and naming Neil R. Pyke and Jamison B. Slippy as inventors.

TECHNICAL FIELD

This invention generally relates to a technology for automatically detecting multiple sheets of print media.

BACKGROUND

Laser printers and copiers are common examples of electrophotographic production devices. In general, the art of electrophotographic production devices (EPDs) is well known. One common problem regarding EPDs is the fact that if a printer erroneously pulls multiple sheets of print media into the printer at one time, the result is either poor print quality or a media jam somewhere within the printer, which can be difficult to remedy.

The focus herein is on one component of EPDs: the registration assembly. Traditionally, the role of the registration assembly is to deskew (i.e., straighten or square up) the print medium before an image is printed on it.

Just before the print medium passes through the imaging area of a printer, the printer stops the medium at an internal portion of the printer called the "registration assembly." One implementation of the registration assembly includes a movable "stop" that pops up and literally stops the progress of the medium through the printer. Another registration assembly implementation includes a pair of rollers, one typically a hard material, like steel, and the other a softer, rubber coated roller, which are pressed together to form a contact area, or nip, and can be made to rotate or can be prevented from rotating. The printer forces the leading edge of the paper into either the stop in the first implementation or the stopped pair of rollers in the second implementation, which deskews (i.e., squares up) the paper. Thus, the registration assembly is responsible for ensuring that the paper travels straight into the fuser unit of the printer where the imaging process is performed. If the printer could detect when multiple sheets of media are fed into the registration assembly, remedial action could be taken to prevent poor print quality or a media jam that is difficult to remove.

The following U.S. Pat. Nos. include a general description of an EPD and/or the role of the registration assembly of such a device: 5,865,121; 6,201,937; and 5,967,511.

SUMMARY

Described herein is a technology for automatically detecting the presence of multiple sheets of print media. More particularly, described herein is a technology for indirectly and automatically determining when multiple sheets of print media are fed into a printer. In the described embodiment, this is accomplished by determining the stiffness of the fed print media.

At least one embodiment, described herein, includes a laser printer registration assembly. In this assembly, the print medium is deflected (i.e., bent, bowed, buckled, etc.). A measurement of such deflection is made. That measurement is an indication of the relative stiffness of the print medium. A deflection measurement of subsequently fed print media is compared to a previous deflection measurement. If a subsequent measurement is greater than, or more specifically, significantly close to an integer multiple of, a previous measurement, then it is determined that multiple sheets have been fed to the printer.

By determining when multiple sheets are fed into the printer, the print process can be aborted, preventing poor print quality or a physical jam.

This summary itself is not intended to limit the scope of this patent. Moreover, the title of this patent is not intended to limit the scope of this patent. For a better understanding of the present invention, please see the following detailed description and appending claims, taken in conjunction with the accompanying drawings. The scope of the present invention is pointed out in the appending claims.

BRIEF DESCRIPTION OF THE DRAWINGS

The same numbers are used throughout the drawings to reference like elements and features.

DETAILED DESCRIPTION

In the following description, for purposes of explanation, specific numbers, materials and configurations are set forth in order to provide a thorough understanding of the described technology. However, it will be apparent to one skilled in the art that the described technology may be practiced without the specific exemplary details. In some instances, well-known features are omitted or simplified to clarify the description of the exemplary implementations and to thereby better explain the described technology. Furthermore, for ease of understanding, certain method steps are delineated as separate steps; however, these separately delineated steps should not be construed as necessarily order dependent in their performance.

The following description sets forth one or more exemplary implementations for automatically detecting the presence of multiple sheets of print media. An example of an embodiment may be referred to as an "exemplary multiple sheet detector."

Introduction

To prevent media jams within a printer, and to ensure good, consistent print quality, the printer detects, early in the print process, when multiple sheets of media are erroneously fed in to the printer. Because multiple sheets of a particular print medium are thicker than one sheet of the print medium, the number of sheets of print medium fed to a printer can be determined based on the thickness of the medium fed to the printer.

The stiffness of a solid material is based upon its density and its thickness. A sheet material of high density and great thickness will be much stiffer than a similarly shaped material of low density and low thickness. If one assumes that print media has approximately the same density, then thickness determines stiffness of a medium. Therefore, stiffness is a good indicator of a print medium's thickness. Thus, because multiple sheets of media are approximately an integer multiple thicker than one sheet of media, stiffness is an inferential indicator of the number of sheets of the medium. For example, three sheets of a print medium are approximately three times thicker than one sheet of the print medium.

The one or more exemplary implementations described herein may be implemented (in whole or in part) by a multiple sheet detection system and/or by a laser printer (or other electrophotographic production device).

In at least one implementation of an exemplary multiple sheet detector, a registration assembly of a laser printer deflects (i.e., bends, bows, buckles, etc.) a print medium, such as a sheet of paper. A measurement related to such deflection is made. That measurement indicates the relative stiffness of the print medium. By measuring the relative stiffness of print media fed to the printer, a determination is made regarding the number of sheets of print media.

Exemplary Multiple Sheet Detector

Figure 1:
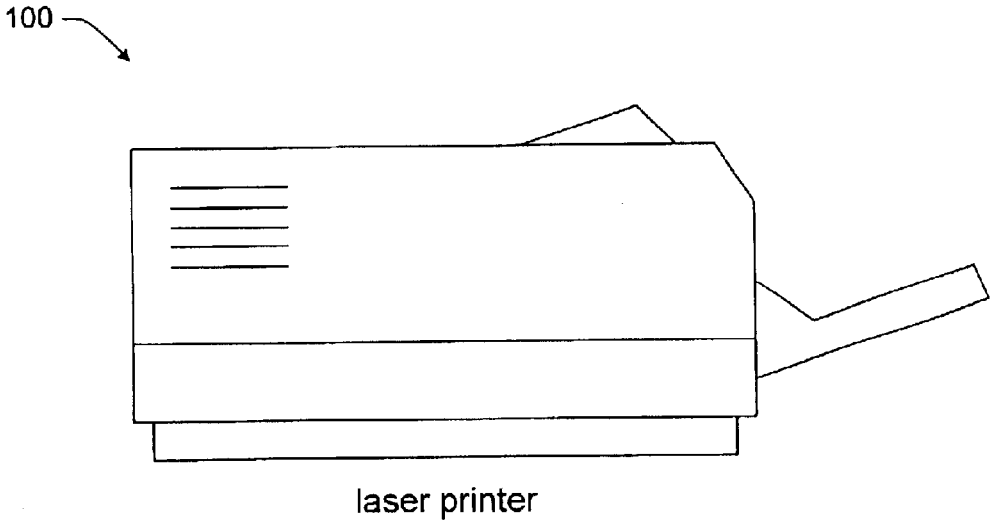
FIG. 1 is a simplified illustration of a typical laser printer which may be employed in accordance with the techniques described below.

FIG. 1 shows a laser printer in which the described techniques may be implemented. Just before the laser printer 100 prints onto a print medium, the printer stops the medium at an internal portion of the printer called a registration assembly.

Figure 2:
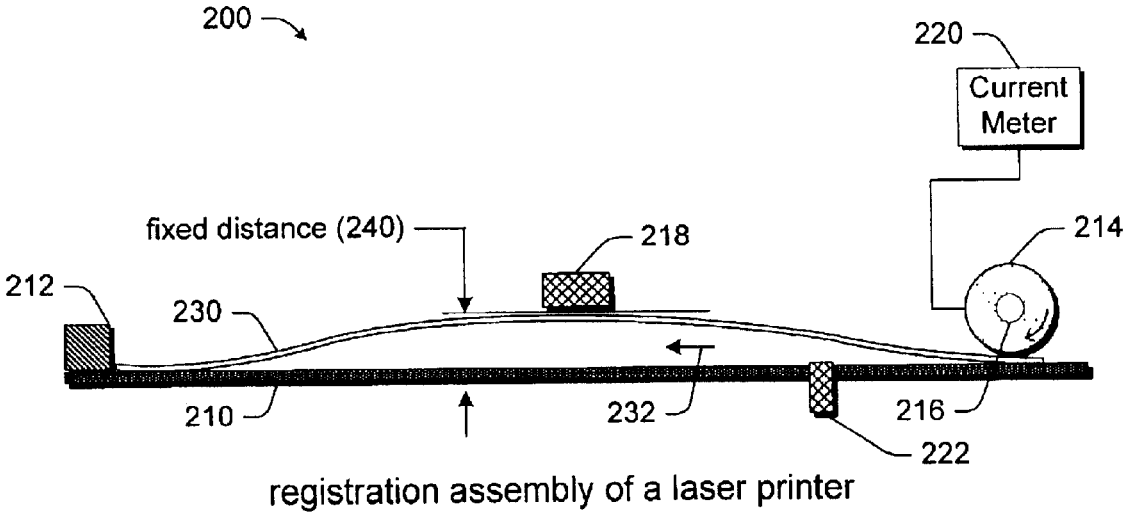
FIG. 2 is a diagram showing of a registration assembly employed in the printer of FIG. 1.

FIG. 2 shows one embodiment of a registration assembly or multiple sheet detection system 200. It includes a base 210, a stop 212, a drive motor 214, a rotary encoder 216, a proximity sensor 218, and an electrical current measuring subsystem 220, which may alternatively be called a current meter.

In the registration assembly, the printer deskews (i.e., square up) a print medium 230 (such as a sheet of paper), which is resting on the base 210, by forcing the leading edge of the print medium 230 into a deskewing mechanism. In FIG. 2, the print medium travels in the direction indicated by arrow 232.

Traditionally, the role of the registration assembly is to ensure that the medium travels straight into the fuser unit of the printer. To do this, the stop 212 pops up to impede the progress of the paper through the printer, enabling deskewing mechanisms and rollers (not shown) to deskew the medium. In an alternate implementation, the stop 212 is immobile. In addition to deskewing the print medium, implemented as a multiple sheet detector, one or more components of the registration assembly may function as a stiffness measurer to automatically determine the relative stiffness of the print medium.

While the assembly 200 holds the leading edge of the medium, the drive motor and roller 214 are positioned at the end of the medium opposite from the stop 212. After deskewing, the stop 212 moves out of the medium's path. The motor 214 is designed to drive the medium further along the print path However, if the stop 212 remains in place and the motor 214 turns (as indicated by the curved arrow on the motor), the medium bends. This bending may also be called deflection, buckling, bowing, crooking, incurvation, inflection, arcuating, arching, and the like. A measure of the medium's resistance to the bending is a measure of its stiffness.

The rotary encoder 216 is positioned on the shaft of the motor 214. It typically is a disk with a plurality of fine lines (etched on the disk). With its optical sensor, it counts the lines as the drive motor rotates to measure how much the roller has turned.

The proximity sensor 218 (or position sensor) is positioned a fixed distance 240 from the base 210 on which the medium is resting in the registration assembly. Typically, it is positioned approximately at the point where the apex of the medium's deflection is expected. This proximity sensor may use contact or non-contact mechanisms to detect the position of the arched medium. Alternatively, it may measure the deflection distance rather than whether the medium has deflected a fixed distance.

The electrical current measuring subsystem 220 (or amp meter or circuitry to measure current) measures the current flowing to the motor 214. By doing so, the relative amount of force used to deflect the medium 230 is measured.

In at least one embodiment of the exemplary multiple sheet detector, the drive motor 214 turns and arcuates the medium 230 until the medium contacts the sensor 218 or until the sensor determines that the medium has been bent a fixed distance 240. The stiffer the medium, the more force the motor 214 must use to bend the medium the fixed distance.

Therefore, a relative measurement of the force used by the motor 214 to bend the medium 230 a fixed distance 240 gives a relative measurement of the medium's stiffness. The force may be measured by measuring how much current is used by the motor 214 to bend the medium. Thus, the indirect measurement of stiffness is the current used by the motor to bend the medium a fixed amount.

The electrical current measuring subsystem 220 measures the amount of current flowing to the motor 214 while it bends the medium. A signal from the position sensor 218 indicates when the current measurement is complete. In this implementation, there is no need for the rotary encoder 216.

Alternatively, the motor 214 may have rotary encoder 216 so that the angle that the roller has turned while bending the medium is measured. In this embodiment, the motor 214 turns a fixed amount (e.g., 30 degrees) and the current is measured. This current measurement would be the measurement of the medium's stiffness. In this implementation, there is no need for the position sensor 218.

Depending upon how the stiffness measurement is accomplished, the registration assembly 200 may include a combination pair of the rotary encoder 216, the proximity sensor 218, and/or the electrical current measuring subsystem 220. The following are examples of combinations that may determine stiffness of the medium 230:

- with current meter 220 and position sensor 218, the motor 214 bends the medium 230 a fixed amount and current is measured;
- with current meter 220 and position sensor 218, the motor 214 receives a fixed amount of current to turn it and distance of deflection is measured;
- with current meter 220 and rotary encoder 216, the motor 214 turns a fixed amount and current is measured.

Methodological Implementation of the Exemplary Multiple Sheet Determiner

Figure 3:
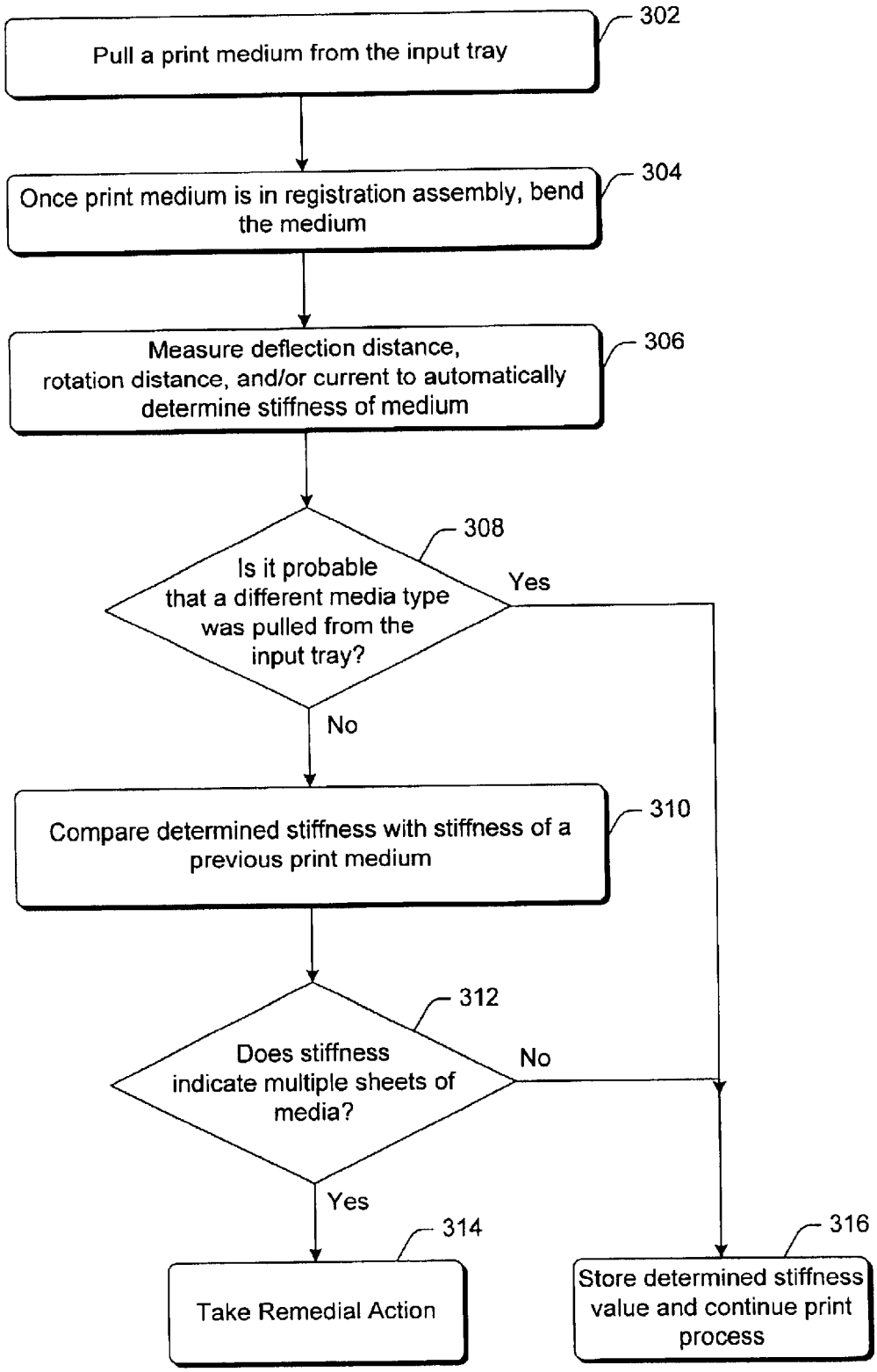
FIG. 3 is a flow chart illustrating methodological aspects employed in the printer of FIG. 1.

FIG. 3 shows methodological implementation of multiple sheet detection performed by the multiple sheet detection system 200 (or some portion thereof).

At 302 of FIG. 3, the printer pulls a print medium from an input tray. At 304, multiple sheet detection system 200 deflects the medium while it is in the registration assembly.

At 306, a measurement is made to determine the stiffness of the medium. The measurement may be of the deflection distance, rotation distance, and/or the current used. This measurement gives an inferential indication of the thickness of the medium.

At 308, the printer examines additional data to determine whether or not it is probable that a different type of print media may have been pulled from the tray compared to the print media associated with a previous thickness measurement. If the printer determines that it is likely that the type of print media in a particular input tray has changed, the printer does not attempt to determine whether the thickness of the print media indicates multiple sheets.

In one implementation, the printer determines whether the print media currently in the registration assembly is the first print media pulled from a particular input tray since the input tray was last opened/closed. If the input tray was opened and/or closed prior the printer pulling the current print media from the tray, then it is more likely that the type of print media in the input tray differs from the type of print media that was in the input tray prior to the tray being opened and closed. Because the media type may differ, the thickness of the media may also differ, and the printer does not attempt to determine whether the current print media consists of multiple sheets.

In another implementation, the printer determines whether the print media currently in the registration assembly is the first print media pulled from a particular input tray since the printer last detected that the input tray was empty. As described above with reference to an input tray being opened/closed, when an input tray is determined to be empty, prior to the printer being able to pull print media from the tray, print media has to be put into the tray. It is likely that a different type of print media may have been put into the tray than the type of print media that was in the input tray prior to the printer determining that the input tray was empty.

In an alternate implementation, the printer determines whether the print media currently in the registration assembly is the first print media pulled from a particular input tray since the printer was last powered on. Because a user may place a different type of print media in an input tray while the printer is powered off, the printer does not attempt to determine whether the current print media consists of multiple sheets.

In another implementation, an optical sensor may be used to determine a general print media type. For example, acetate and mylar transparency, also known as overhead transparency (OHT), are transparent. In this implementation, a printer may include an optical sensor 222 to determine if the media is transparent. This optical sensor may be in the registration assembly as shown in FIG. 2 or it may be located elsewhere in the paper path. The optical sensor may be used to determine whether or not the current print media is transparent. If the current print media is transparent and a previous print media was not transparent (or visa versa), then the printer does not attempt to determine whether the current print media consists of multiple sheets.

At block 316 (the "Yes" branch from block 308), when the printer determines that it is likely that the print media differs from a previous print media pulled from the same input tray, the printer stores the stiffness measurement associated with the current print media and continues with the print process. Because there are often multiple media input sources associated with a printer (e.g., internal paper cassettes, drawers, trays, multi-purpose (MP) trays, etc.), the printer may store a recently measured stiffness associated with each of the printer's input sources.

At block 310 (the "No" branch from block 308), when the printer determines that it is not likely that the print media differs from a previous print media pulled from the same input tray, the printer compares the stiffness measurement associated with the current print media with a determined thickness of a previous print medium pulled from the same input tray.

At 312, a print processor determines any difference between the thickness of the current print medium and a previous print medium. If the thickness of the current print medium is greater than the thickness of a previous print medium, then it is assumed that multiple sheets of medium have been fed into the printer.

Due to the fact that different types of print media have different thickness (e.g., mylar, plain paper, and cardstock), simply determining that a print media is thicker than a previous print media may not accurately indicate that multiple sheets of media have been fed to the printer. For example, feeding a sheet of bond paper to a printer after feeding a sheet of plain paper to the printer would result in the determination that the second sheet of media (the bond paper) is thicker than the first sheet of media (the plain paper), and the printer would erroneously determine that multiple sheets of media had been fed to the printer.

Therefore, in an alternate implementation, a printer determines that multiple sheets of media have been fed to the printer if the thickness of a print media is at least two times the thickness of a previous print media.

However, in this described implementation, the printer may erroneously determine that multiple sheets of media have been fed to the printer if a second media is more than twice as thick as a previous media. For example, a sheet of cardstock may be more than two times thicker than a sheet of plain paper. In this example, if a sheet of plain paper is fed to the printer followed by a sheet of cardstock, the printer will erroneously indicate that multiple sheets of media were fed to the printer.

In an exemplary implementation, a printer determines that multiple sheets of media have been fed to the printer if the thickness of a print media is approximately an integer (greater than one) multiple of the thickness of a previous print medium. In this implementation, erroneous determinations of multiple sheets of media are minimized, and occur if one sheet of a second print media happens to have a thickness that is approximately an integer multiple greater than one sheet of a previous print media.

If, at 312, the print processor determines that the thickness of the current print medium is not approximately an integer multiple of the thickness of the previous print medium, then it is assumed that only one sheet of medium have been fed into the printer, and at 316, the printer stores the stiffness measurement associated with the current print media and the print process continues.

If however, at 312, the print processor determines that the thickness of the current print medium indicates that multiple sheets of print medium have been fed into the printer, then at 314, the print processor performs some sort of remedial action. In one implementation, the print processor sends a user notification indicating the presence of multiple sheets of print media. In an alternate implementation, the print processor aborts the print process. The print processor may perform any action to correct the perceived condition of multiple sheets of print media in the registration assembly.

In an alternate implementation, the printer may send data indicating the measured stiffness of print media as well as data indicating the detection of multiple sheets of media to a data repository. The data repository may be stored in memory on the printer, or may be stored in a remote data repository housed elsewhere. A printer manufacturer may then use the stored data to better understand how a customer base uses a printer (e.g., what print media thicknesses are most common) and to determine whether a printer is performing within manufacturer printer jam and/or multiple sheet feed target rates. The data may also be used to determine what media types cause multiple sheet feeds most frequently.

Exemplary Printer Architecture

Figure 4:
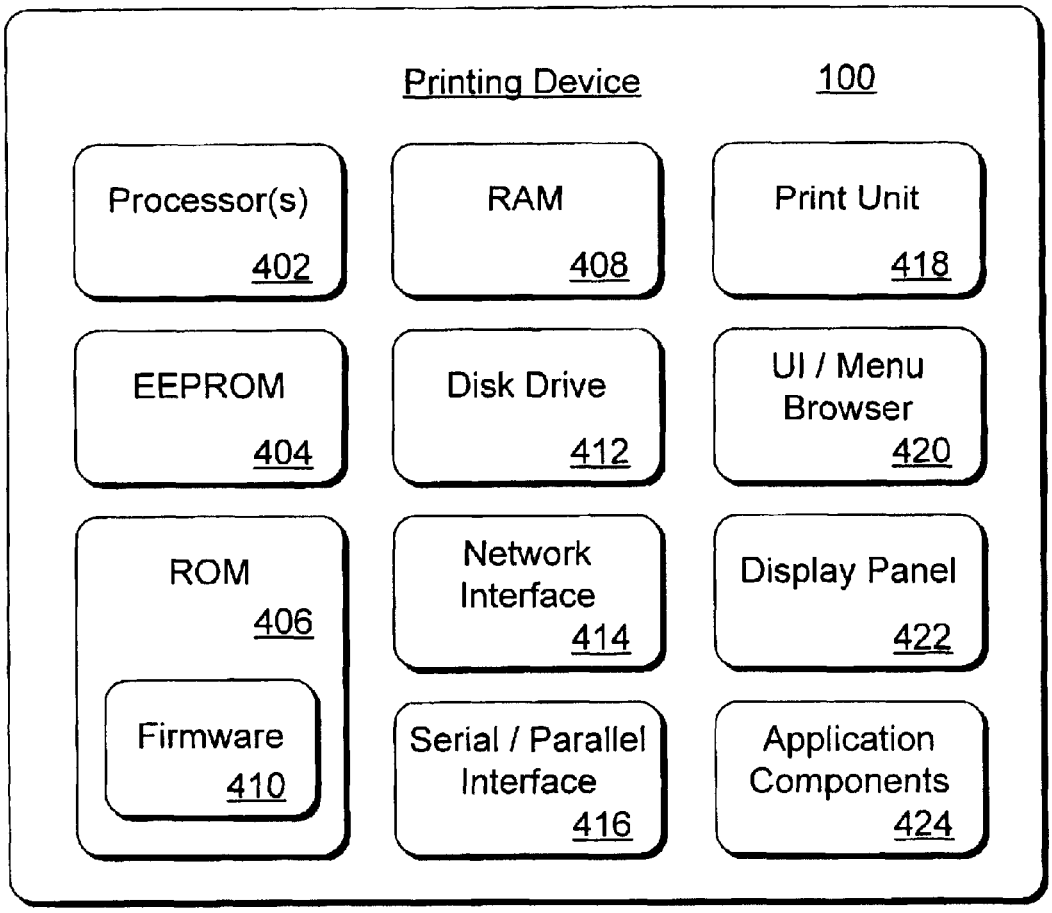
FIG. 4 is an example of a computing operating environment in which the described techniques can be implemented.

FIG. 4 illustrates various components of an exemplary printing device 100 that can be utilized to implement the inventive techniques described herein. Printer 100 includes one or more processors 402, an electrically erasable programmable read-only memory (EEPROM) 404, ROM 406 (non-erasable), and a random access memory (RAM) 408. Although printer 100 is illustrated having an EEPROM 404 and ROM 406, a particular printer may only include one of the memory components. Additionally, although not shown, a system bus typically connects the various components within the printing device 100.

The printer 100 also has a firmware component 410 that is implemented as a permanent memory module stored on ROM 406. The firmware 410 is programmed and tested like software, and is distributed with the printer 400. The firmware 410 can be implemented to coordinate operations of the hardware within printer 100 and contains programming constructs used to perform such operations.

Processor(s) 402 process various instructions to control the operation of the printer 100 and to communicate with other electronic and computing devices. The memory components, EEPROM 404, ROM 406, and RAM 408, store various information and/or data such as configuration information, fonts, templates, data being printed, and menu structure information. Although not shown, a particular printer can also include a flash memory device in place of or in addition to EEPROM 404 and ROM 406.

Printer 100 also includes a disk drive 412, a network interface 414, and a serial/parallel interface 416. Disk drive 412 provides additional storage for data being printed or other information maintained by the printer 100. Although printer 100 is illustrated having both RAM 408 and a disk drive 412, a particular printer may include either RAM 408 or disk drive 412, depending on the storage needs of the printer. For example, an inexpensive printer may include a small amount of RAM 408 and no disk drive 412, thereby reducing the manufacturing cost of the printer.

Network interface 414 provides a connection between printer 100 and a data communication network. The network interface 414 allows devices coupled to a common data communication network to send print jobs, menu data, and other information to printer 100 via the network. Similarly, serial/parallel interface 416 provides a data communication path directly between printer 100 and another electronic or computing device. Although printer 100 is illustrated having a network interface 414 and serial/parallel interface 416, a particular printer may only include one interface component.

Printer 100 also includes a print unit 418 that includes mechanisms arranged to selectively apply the imaging material (e.g., liquid ink, toner, etc.) to a print media such as paper, plastic, fabric, and the like in accordance with print data corresponding to a print job. For example, print unit 418 can include a conventional laser printing mechanism that selectively causes toner to be applied to an intermediate surface of a drum or belt. The intermediate surface can then be brought within close proximity of a print media in a manner that causes the toner to be transferred to the print media in a controlled fashion. The toner on the print media can then be more permanently fixed to the print media, for example, by selectively applying thermal energy to the toner.

Print unit 418 can also be configured to support duplex printing, for example, by selectively flipping or turning the print media as required to print on both sides. Those skilled in the art will recognize that there are many different types of print units available, and that for the purposes of the present invention, print unit 418 can include any of these different types.

Printer 100 also includes a user interface and menu browser 420, and a display panel 422. The user interface and menu browser 420 allows a user of the printer 100 to navigate the printer's menu structure. User interface 420 can be indicators or a series of buttons, switches, or other selectable controls that are manipulated by a user of the printer. Display panel 422 is a graphical display that provides information regarding the status of the printer 100 and the current options available to a user through the menu structure.

Printer 100 can, and typically does include application components 424 that provide a runtime environment in which software applications or applets can run or execute. One exemplary runtime environment is a Java Virtual Machine (JVM). Those skilled in the art will recognize that there are many different types of runtime environments available. A runtime environment facilitates the extensibility of printer 100 by allowing various interfaces to be defined that, in turn, allow the application components 424 to interact with the printer.

CONCLUSION

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimd is:

1. A system for automatically determining whether multiple sheets of media are being fed, the system comprising:

a stiffness measurer configured to measure a stiffness associated with fed media;

a processor configured to determine whether multiple sheets of media are being fed based upon the measured stiffness and to take remedial action.

2. A system as recited in claim 1 wherein the remedial action comprises notifying a user.

3. A system as recited in claim 1 wherein the remedial action comprises aborting a print process.

4. A system as recited in claim 1 further comprising an optical sensor to determine whether the media is transparent.

5. A system as recited in claim 1 further comprising a media deflector configured to bow the media.

6. A system as recited in claim 5, wherein the media deflector comprises:

a motor configured to drive the media along a path; and a stop configured to impede the media from traversing in a least one direction.

7. A system as recited in claim 5, wherein the stiffness measurer further comprises:

an electrical current measuring subsystem configured to measure current used to bow the media; and a position sensor configured to determine a distance that the media deflects when bowed by the deflector.

8. A system as recited in claim 5, wherein the stiffness measurer further comprises:

an electrical current measuring subsystem configured to measure current used by to bow the media; and a position sensor configured to detect when the media bows a fixed amount.

9. A system as recited in claim 5, wherein the stiffness measurer further comprises:

an electrical current measuring subsystem configured to measure current required to bow the media; and a rotary encoder configured to determine the degree of rotation of the motor while the motor bows the media.

10. A printer comprising:

a system for automatically detecting multiple sheets of media fed into the printer, wherein the system comprises:

a media deflector configured to bow print media; and a stiffness measurer configured to measure the print media's resistance to bowing by the deflector; and a means for taking remedial action.

11. A printer as recited in claim 10 wherein the system comprises:

a motor configured to drive the media along a path when the motor turns; and a stop configured to impede the media from traversing in at least one direction.

12. A method for automatically detecting when multiple sheets of print media are fed to a printing device, the method comprising:

transporting a first print medium through the printing device;

determining the stiffness of the first print medium;

transporting a second print medium through the printing device;

determining the stiffness of the second print medium;

taking remedial action when the stiffness of the second print medium indicates that the second print medium comprises multiple sheets of print medium.

13. A method as recited in claim 12, wherein the first and second print media are fed to the printing device from the same media input source.

14. A method as recited in claim 13, wherein the media input source is one of a group of media input sources comprising an internal paper cassette, a drawer, a tray, and a multi-purpose tray.

15. A method as recited in claim 12, wherein the determining the stiffness of the second print medium comprises measuring an amount that the second medium deflects.

16. A method as recited in claim 12, wherein the determining the stiffness of the second print medium comprises measuring an amount that drive rollers turn.

17. A method as recited in claim 12, wherein the determining the stiffness of the second print medium comprises measuring energy used to turn drive rollers.

18. A method as recited in claim 12, wherein the second print medium indicates that the second print medium comprises multiple sheets of print medium if the stiffness of the second print medium is greater than the stiffness of the first print medium.

19. A method as recited in claim 12, wherein the second print medium indicates that the second print medium comprises multiple sheets of print medium if the stiffness of the second print medium is at least two times the stiffness of the first print medium.

20. A method as recited in claim 12, wherein the second print medium indicates that the second print medium comprises multiple sheets of print medium if the stiffness of the second print medium is approximately equal to an integer greater than one multiplied by the stiffness of the first print medium.

21. A method as recited in claim 12, wherein the taking remedial action comprises aborting a print process.

22. A method as recited in claim 12, wherein the taking remedial action comprises notifying a user.

23. A method as recited in claim 12, further comprising determining that the first and second print media are not likely to be of different media types.

24. A method as recited in claim 23, wherein the determining that the first and second print media are not likely to be of different media types comprises determining that the printer was not powered off after the first print media was fed into the printer and before the second print media was fed into the printer.

25. A method as recited in claim the determining that the first and second print media are not likely to be of different media types comprises determining that an input tray from which the first and second print media are fed into the printer was not opened and closed after the first print media was fed into the printer and before the second print media was fed into the printer.

26. A method as recited in claim 23, wherein the determining that the first and second print media are not likely to be of different media types comprises determining that an input tray from which the first and second print media are fed into the printer was not empty after the first print media was fed into the printer and before the second print media was fed into the printer.

27. A method as recited in claim 23, wherein the determining that the first and second print media are not likely to be of different media types comprises:

determining that the first print media is transparent; and determining that the second print media is not transparent.

28. A method as recited in claim 23, wherein the determining that the first and second print media are not likely to be of different media types comprises:

determining that the first print media is not transparent; and determining that the second print media is transparent.

29. A method for automatically determining whether multiple sheets of a media being processed are superposed, the method comprising:

sensing a first value of a parameter associated with the media being processed that varies in response to a thickness of the media;

comparing the first value with a second value for the parameter associated with a second media; and determining whether the first media being processed and the second media are likely to be of the same media type.

30. The method of claim 29, wherein the parameter includes a stiffness measurement.

31. The method of claim 29, wherein the second value for the parameter is obtained by sensing the second media.

32. The method of claim 31, wherein determining whether the first media being processed and the second media are likely to be the same media type includes determining whether a media processing device was powered off after the second value was sensed and before the first value was sensed.

33. The method of claim 31, wherein determining whether the first media being processed and the second media are likely to be of the same media type includes determining whether an input tray associated with a media processing device has been at least one of opened or closed.

34. The method of claim 31, wherein determining whether the first media being processed and the second media are likely to be of the same media type includes determining whether an input tray associated with a media processing device was empty prior to sensing the first value.

35. The method of claim 31, wherein determining whether the first media being processed and the second media are likely to be of the same media type includes:

determining whether the first media being processed is transparent; and determining whether the second media is transparent.

36. The method of claim 29 including taking remedial action based upon the comparison of the first value for the parameter and the second value for the parameter.

37. The method of claim 29 including printing upon the first media.

* * * * *

UNITED STATES PATENT AND TRADEMARK OFFICE

CERTIFICATE OF CORRECTION

PATENT NO. : 6,832,760 B2
DATED : December 21, 2004
INVENTOR(S) : Robert W. Jewell It is certified that error appears in the above-identified patent and that said Letters Patent is hereby corrected as shown below:

Column 3,
Line 59, after "print path" insert -- . --.

Column 8,
Line 65, delete "a least" and insert therefor -- at least --.

Column 10,
Line 24, after "in claim" and before "the determining" insert -- 24, wherein --.

Signed and Sealed this

Sixth Day of September, 2005

JON W. DUDAS
*Director of the United States Patent and Trademark Office*